US007938064B2

(12) United States Patent
Albrecht et al.

(10) Patent No.: US 7,938,064 B2
(45) Date of Patent: May 10, 2011

(54) PRINTING UNIT OF A WEB-FED ROTARY PRESS

(75) Inventors: Stefan Albrecht, Neusäß (DE); Rainer Burger, Augsburg (DE); Norbert Dylla, Stadtbergen (DE); Helmut Stuhlmiller, Altenmünster (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 935 days.

(21) Appl. No.: 11/404,473

(22) Filed: Apr. 13, 2006

(65) Prior Publication Data

US 2006/0230954 A1 Oct. 19, 2006

(30) Foreign Application Priority Data

Apr. 13, 2005 (DE) ..... 10 2005 017 181

(51) Int. Cl.
*B41F 7/02* (2006.01)

(52) U.S. Cl. ..... 101/217; 101/180; 101/181

(58) Field of Classification Search ..... 101/217, 101/180, 181
See application file for complete search history.

(56) References Cited

U.S. PATENT DOCUMENTS

| | | | | |
|---|---|---|---|---|
| 5,205,039 | A | 4/1993 | Ternes | |
| 6,467,408 | B1 * | 10/2002 | Hillebrand | 101/217 |
| 6,834,585 | B2 | 12/2004 | Hahn | |
| 7,044,054 | B2 * | 5/2006 | Stiel | 101/216 |
| 2002/0148373 | A1 | 10/2002 | Dumais et al. | |
| 2004/0079247 | A1 | 4/2004 | Dylla | |

FOREIGN PATENT DOCUMENTS

| | | |
|---|---|---|
| CH | 3 45 906 | 4/1960 |
| CH | 345906 | 4/1960 |
| DE | 199 61 574 A1 | 7/2001 |
| DE | 102 49 947 A1 | 5/2004 |
| DE | 10 321 989 A1 | 8/2004 |
| DE | 103 21 989 | 8/2004 |
| DE | 10 2005 048 619 A1 | 4/2006 |
| EP | 1 314 559 A1 | 5/2003 |
| JP | 10-071694 | 3/1998 |
| JP | 08230101 | 3/1998 |

OTHER PUBLICATIONS

Search Report dated Apr. 13, 2005 issued for the corresponding German Application No. 10 2005 017 181.8.

* cited by examiner

*Primary Examiner* — Leslie J. Evanisko
*Assistant Examiner* — Matthew G Marini
(74) *Attorney, Agent, or Firm* — Cohen Pontani Lieberman & Pavane LLP

(57) ABSTRACT

A printing unit of a web-fed rotary press has a plurality of press units, each press unit having a form cylinder, a transfer cylinder, an inking unit and optionally a damping unit, and having at least one impression cylinder. Each form cylinder rolls on the respective transfer cylinder and each transfer cylinder rolling on an impression cylinder in a thrown-on position of the printing unit, in order to apply single-color printed images onto a printing material which is moved through between the transfer cylinders and the or each impression cylinder. Each form cylinder bears a plurality of printing images next to one another in the axial direction, by which corresponding single-color printed images are applied to the printing material. The printing images which are arranged next to one another in the axial direction of the respective form cylinder are offset with respect to one another in the circumferential direction in such a way that deviations in the circumferential register between the single-color printed images which are to be printed in different press units can be compensated for.

7 Claims, 2 Drawing Sheets

PRINTING UNIT OF A WEB-FED ROTARY PRESS

BACKGROUND OF THE INVENTION

1. Field of the Invention

The invention relates to a printing unit of a web-fed rotary press having a plurality of press units and at least one impression cylinder, each press unit having a printing cylinder and a transfer cylinder for printing single color images on a web.

2. Description of the Related Art

Printing units of web-fed rotary presses, in particular of newspaper presses, have a plurality of press units, each press unit comprising a transfer cylinder, a forme cylinder and an inking unit, and optionally a damping unit. The forme cylinders are also called plate cylinders and the transfer cylinders are also called blanket cylinders. Furthermore printing units of this type can have impression cylinders, it being possible for one impression cylinder to interact with one or more transfer cylinders of different press units. The transfer cylinders are also called satellite cylinders. In addition to printing units which have impression cylinders of this type, printing units are also known which do not have impression cylinders, the transfer cylinders of two press units rolling on one another in printing units of this type without impression cylinders. Accordingly, a web-fed rotary printing unit having a plurality of press units comprises a plurality of forme cylinders and a plurality of transfer cylinders and optionally one or more impression cylinders. The present invention relates to printing units which have a plurality of forme cylinders, a plurality of transfer cylinders and at least one impression cylinder. Printing units of this type are also called satellite printing units. Satellite printing units of web-fed rotary presses usually have four press units and accordingly four forme cylinders and four transfer cylinders and one or two impression cylinders. Satellite printing units of this type having four press units and one impression cylinder are called nine-cylinder printing units; printing units having four press units and two impression cylinders are called ten-cylinder printing units, in contrast.

In a satellite printing unit of this type, single-color printed images for preferably a plurality of printed pages are applied in the region of each press unit in one printing color onto the printing material which is moved through between the transfer cylinders and the or each impression cylinder. For this purpose, in what is known as a thrown-on position of the printing unit, a pressure has to be applied firstly between the forme cylinders and the transfer cylinders of the press units and secondly between the transfer cylinders and the respective impression cylinders, this pressure being provided by pivoting in or throwing on the transfer cylinders to the respective forme cylinder and to the respective impression cylinder. For this purpose, the transfer cylinders are usually mounted eccentrically and positioned relative to the respective forme cylinder and impression cylinder in such a way that a center point of the transfer cylinders does not lie on a connecting line between center points of the corresponding forme cylinders and impression cylinders. Rather, a connecting line of a center point of a transfer cylinder with the center point of the corresponding impression cylinder encloses an angle between 5° and 40° with the connecting line of the center points of the corresponding forme cylinders and impression cylinders.

The transfer cylinders, the forme cylinders and the or each impression cylinder of printing units of this type are subjected to deflection on account of their inherent weight and on account of the pressure or contact forces. This deflection depends, in particular, on the design of the cylinders, relatively thin cylinders being subjected to a relatively pronounced deflection. As a result of the deflection of the transfer cylinders and forme cylinders and impression cylinders, a considerable deviation in the circumferential register can be produced between the single-color printed images which are to be printed in the different press units of the printing unit, which deviation impairs the print quality. As has already been mentioned, these deviations in the circumferential register are particularly pronounced when relatively thin cylinders are present.

In relatively thin cylinders, the ratio of printed pages or printed images which are positioned next to one another axially to printed pages or printed images which are positioned behind one another in the circumferential direction is great, as, for example, in 6/2 cylinders in which six printed pages or printed images are positioned next to one another in the axial direction and in each case two printed pages or printed images are positioned behind one another in the circumferential direction. The same is true for 3/1 cylinders, 4/1 cylinders or else 6/1 cylinders.

SUMMARY OF THE INVENTION

Proceeding from this, the present invention is based on the problem of providing a novel printing unit of a web-fed rotary press having minimized deviations in the circumferential register.

According to the invention, each forme cylinder of each press unit bears at least one printing forme, in such a way that each forme cylinder bears a plurality of printing images next to one another in the axial direction, via which printed images the corresponding single-color printed images are applied to the printing material, the number of printing images which lie next to one another axially corresponding to the number of printed pages which are to be printed onto the printing material axially next to one another, and the printed images which are arranged next to one another in the axial direction of the respective forme cylinder being offset with respect to one another in the circumferential direction in the region of at least one forme cylinder in such a way that deviations in the circumferential register between the single-color printed images which are to be printed in different press units can be compensated for.

Preferred developments of the invention result from the following description. Without being restricted thereto, exemplary embodiments of the invention will be explained in greater detail using the drawing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
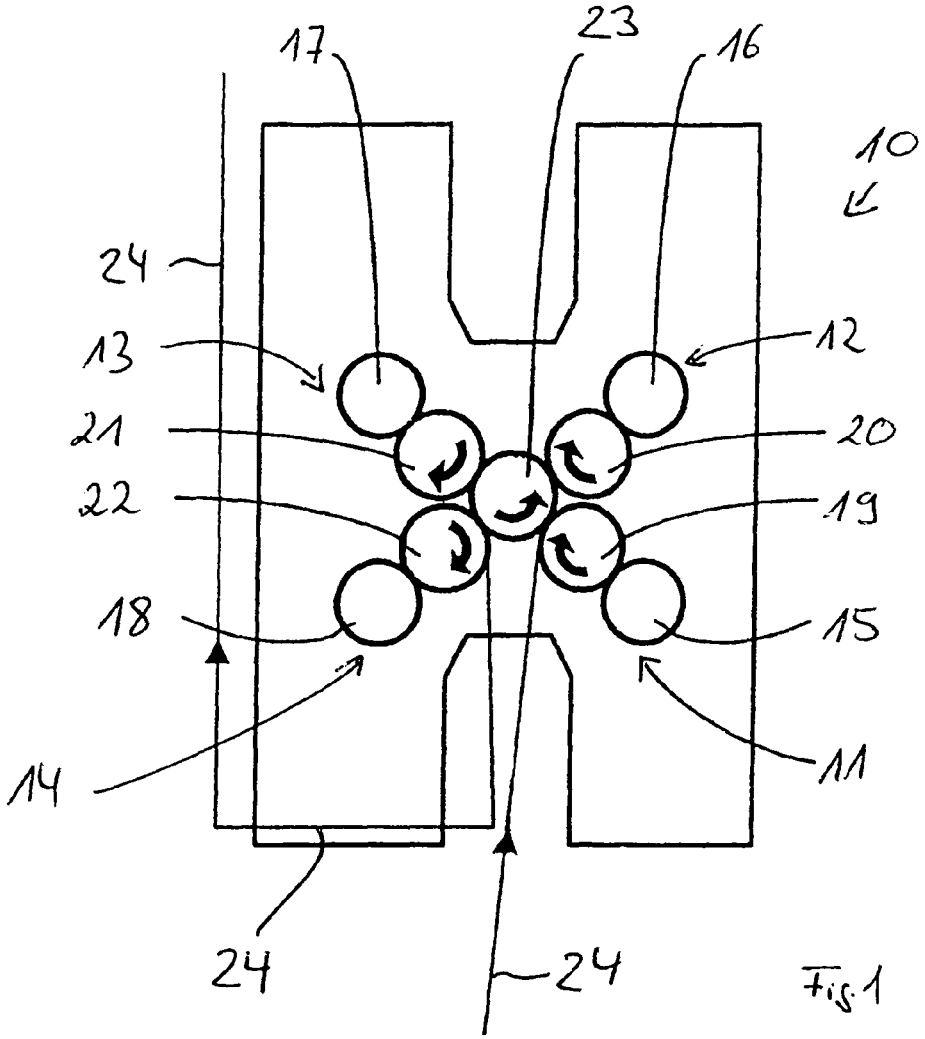
FIG. 1 is a schematic and view of a printing unit of a web-fed rotary press.

FIG. 1 shows a printing unit 10 of a web-fed rotary press, the printing unit 10 including four press units 11, 12, 13 and 14 and, accordingly, four forme cylinders 15, 16, 17 and 18, and four transfer cylinders 19, 20, 21 and 22. In addition to the forme cylinders 15 to 18 and transfer cylinders 19 to 22 shown, the press units 11 to 14 have inking units (not shown) and optionally damping units. In the printing unit 10 of FIG. 1, each forme cylinder 15 to 18 of each press unit 11 to 14 rolls on the respective transfer cylinder 19 to 22 of the corresponding press unit 11 to 14, all of the transfer cylinders 19 to 22 of all of the press units 11 to 14 rolling on a common impression cylinder 23. Accordingly, the printing unit of FIG. 1 is configured as what is known as a nine-cylinder printing unit.

At least one printing forme (plate) is positioned on each of the forme cylinders 15 to 18 in such a way that each forme cylinder 15 to 18 bears a plurality of printing images next to one another in the axial direction and optionally behind one another in the circumferential direction, in order to apply corresponding single-color printed images to a printing material 24. The number of printing images which lie next to one another axially corresponds to the number of printed pages which are to be printed onto the printing material 24 axially next to one another.

In the printing unit 10, the web-shaped printing material 24 is accordingly printed in the region of each press unit 11 to 14 with single-color printed images in one printing color for a plurality of printed pages which are arranged next to one another in the axial direction and optionally behind one another in the circumferential direction, the printing material 24 being moved through between the transfer cylinders 19 to 22 and the impression cylinder 23 for this purpose, according to FIG. 1. Here, first single-color printed images are applied in the region of the printing unit 11 to the printing material 24, and further single-color printed images are printed one after another in the press units 12, 13 and 14 onto the printing material 24. It is necessary, in particular, to minimize displacements in the circumferential register between the single-color printed images which are to be printed in the different press units in order to achieve as high a print quality as possible, in order that the single-color printed images are printed onto the printing material 24 with exact congruence.

Figure 2:
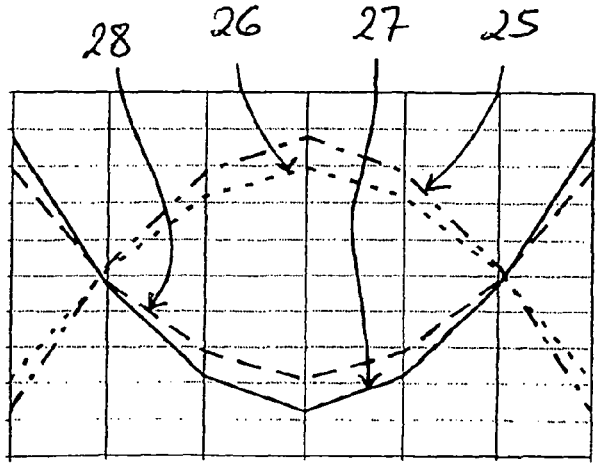
FIG. 2 is a plot showing a deviation in the circumferential direction which is produced in the press unit of FIG. 1.

As the forme cylinders 15 to 18, the transfer cylinders 19 to 22 and the impression cylinder 23 are subjected to a deflection as a consequence of their inherent weight and the contact forces which act on them during printing, a straight, horizontal line on the forme cylinders 15 to 18 is shown curved on the printing material 24. Accordingly, in the printing unit 10 of FIG. 1, the deviations in the circumferential register which are shown in FIG. 2 result between the single-color printed images which are to be printed in the press units 11 to 14. In FIG. 2, the axial extent of the cylinders or the width of the printing-material web is plotted on the horizontal axis and the curvature of the lines which are transferred by the forme cylinders 15 to 18 relative to the transport direction of the printing material 24 is plotted on the vertical axis. The curve 25 corresponds to the curvature of a line which is printed onto the printing material 24 in the press unit 11 by the forme cylinder 15 and via the transfer cylinder 19. The curve 26 corresponds to the curvature of the line which is printed in the press unit 12 by the forme cylinder 16 and via the transfer cylinder 20. In the same way, a straight, horizontal line on the forme cylinder 17 in the press unit 13 becomes the arched curve 27 during the transfer of ink via the transfer cylinder 21, and a straight, horizontal line on the forme cylinder 18 in the press unit 14 becomes the arched curve 28 on the printing material 24 during the transfer of ink via the transfer cylinder 22. The vertical spacing between the curves 25 to 28 corresponds to the deviation in the circumferential register at the respective axial position of the printing material between the single-color printed images which are to be printed in the press units 11 to 14.

Here, in particular, the deviations in the circumferential register between the press units which are passed through by the printing material 24 in a different transport direction are particularly large. It can thus be gathered from FIG. 1 that the transport direction of the printing material 24 changes between the press units 12 and 13, for which reason the deviations in the circumferential register between the press units 11 and 13, 11 and 14, 12 and 13 and 12 and 14 are greater than the deviations in the circumferential register between the press units 11 and 12 and 13 and 14.

In order to compensate for deviations in the circumferential register between the single-color printed images which are to be printed in the different press units 11 to 14, it is proposed within the context of the present invention that the printed images which are arranged next to one another in the axial direction of each forme cylinder 15 to 18 are offset with respect to one another in the circumferential direction. As a result, the deviations in the circumferential register can be compensated for in a particularly simple manner.

Figure 3:
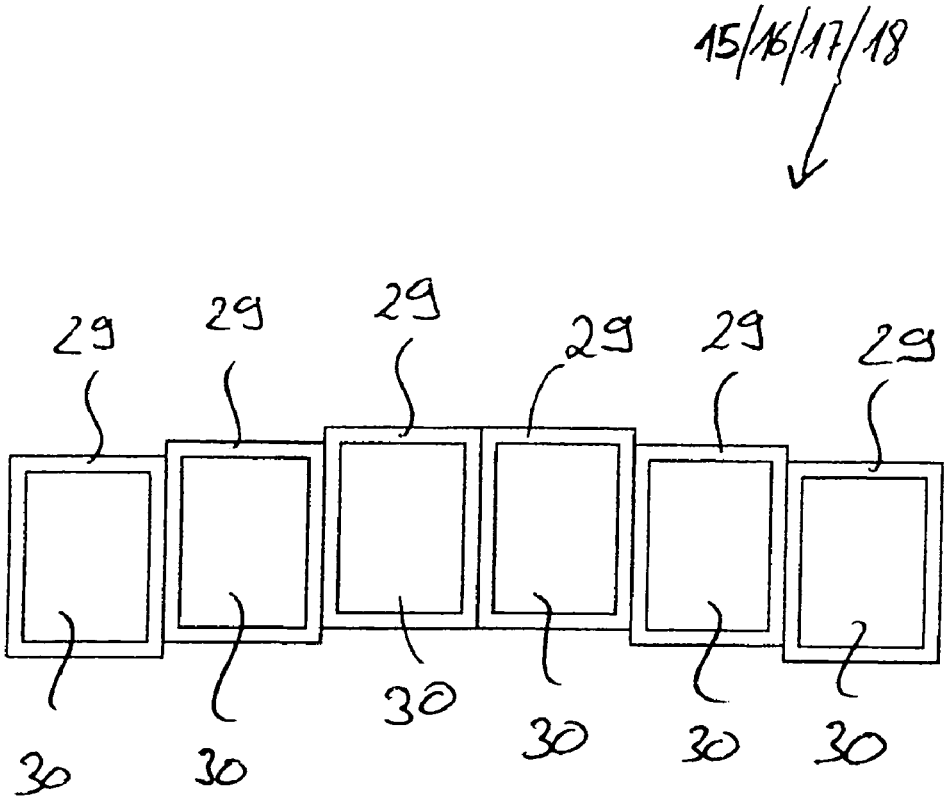
FIG. 3 is a schematic view of a forme cylinder of a printing unit according to the invention, according to a first exemplary embodiment of the invention.

FIG. 3 shows a forme cylinder 15 or 16 or 17 or 18 of the printing unit 10 according to the invention, which forme cylinder bears six printing formes next to one another in the axial direction which are configured as printing plates 29, each of the printing plates 29 bearing a printing image 30. In the exemplary embodiment of FIG. 3, the position of the printing images 30 on the printing plates 29 is identical throughout, but the positions of the printing plates 29 which are arranged next to one another on a forme cylinder in the axial direction are offset in the circumferential direction with respect to one another on the respective forme cylinder. Here, the offset is defined by the deviation in the circumferential register which is to be expected in FIG. 2 between the single-color printed images which are to be printed in the individual press units 11 to 14.

Figure 4:
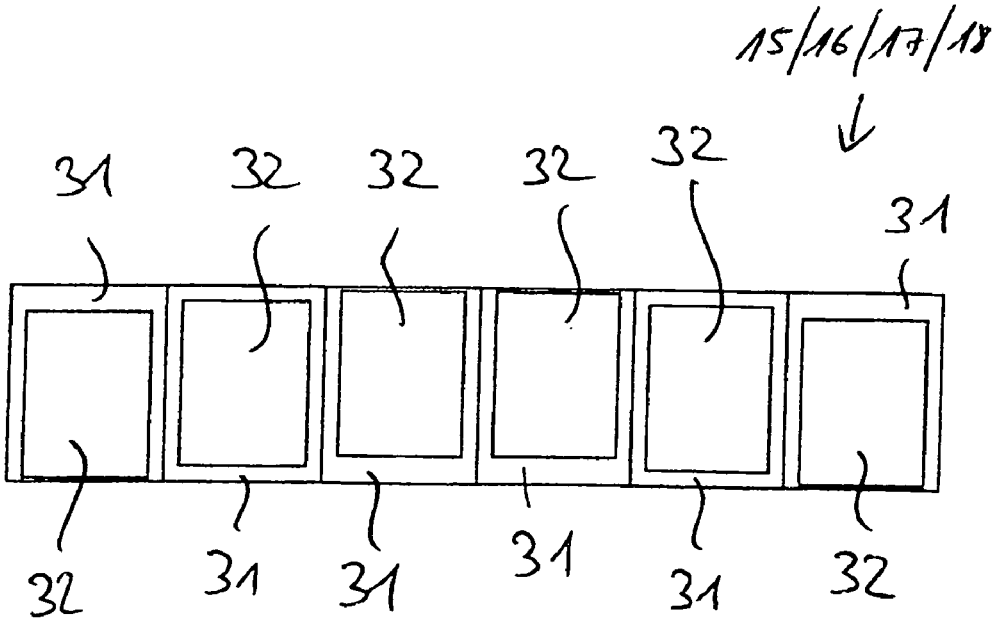
FIG. 4 is a schematic view of a forme cylinder of a printing unit according to the invention, according to a second exemplary embodiment of the invention.

FIG. 4 shows one exemplary embodiment of the invention, in which six printing plates 31 are positioned next to one another on a forme cylinder 15 or 16 or 17 or 18, once again in the axial direction of the forme cylinder, each of the printing plates 31 once again bearing one printing image 32. In the exemplary embodiment of FIG. 4, the circumferential positions of the printing plates 31 which are positioned axially next to one another on a forme cylinder do not differ from one another, rather the printing images 32 on the printing plates 31 are offset with respect to one another in the circumferential direction in order to compensate for the deviations in the circumferential register between the single-color printed images which are to be printed in different press units. For this purpose, the printing plates 31 are exposed with printing images 32 which are offset with respect to one another in the circumferential direction. This has the advantage that no structural changes have to be performed on the plate clamping systems of the forme cylinders, with the result that the invention can also be used in existing printing units.

The number of printing plates or printing images which are arranged next to one another in the axial direction which is shown in FIGS. 3 and 4 is purely by way of example. It is likewise possible for a plurality of printing plates to be arranged at each axial position behind one another in the circumferential direction, which printing plates are then offset with respect to one another in the circumferential direction within the context of the present invention. Each printing plate can also have more than one printing image, namely when a plurality of printed pages are printed with one printing plate.

The invention can also be used in press units, on the forme cylinders of which printing formes which are configured as printing sleeves are arranged. A plurality of printing images for a plurality of printed pages are then arranged next to one another in the axial direction on printing sleeves of this type, the printing images being offset with respect to one another in the circumferential direction, in order to compensate for the deviations in the circumferential register between the single-color printed images which are to be printed in the different press units. Accordingly, the invention is not restricted to the use of printing formes which are configured as printing plates.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A printing unit of a web-fed rotary press, the printing unit comprising a plurality of press units and at least one impression cylinder, each said press unit comprising:

a forme cylinder bearing a plurality of printing images next to each other in an axial direction, each said printing image corresponding to a single color printed image applied to a printing material; and a transfer cylinder rolling on the at least one impression cylinder in a thrown-on position of the printing unit in order to transfer ink from the printing images on a respective said forme cylinder to a printing material, thereby forming printed images;

wherein the forme cylinder and the transfer cylinder are subjected to a deflection during printing causing a deviation in a circumferential register between the printed images; and wherein said printing images on at least one of said forme cylinders are offset circumferentially with respect to each other based at least in part on the deflection of the forme cylinder and the transfer cylinder during printing so that the deviations in the circumferential register between the single-color printed images applied by the respective press units are compensated for whereby the printed images are longitudinally aligned along the axial direction.

2. The printing unit of claim 1 wherein each said forme cylinder carries a plurality of printing plates arranged next to one another in an axial direction, each said printing plate carrying a respective said printing image.

3. The printing unit of claim 2 wherein the printing plates on each said forme cylinder occupy positions which are offset circumferentially with respect to each other.

4. The printing unit of claim 2 wherein printing plates on each said forme cylinder are circumferentially aligned, only the printing images thereon being circumferentially offset.

5. The printing unit of claim 1 wherein each said forme cylinder carries a printing sleeve, said printing images being arranged on said printing sleeve.

6. The printing unit of claim 1 wherein said printing unit is configured as a nine cylinder printing unit having four said press units and a single said impression cylinder.

7. The printing unit of claim 1 wherein said printing unit is configured as a ten cylinder printing unit having four said press units and two said impression cylinders.

* * * * *